US010264843B1

(12) United States Patent
Whitcomb et al.

(10) Patent No.: US 10,264,843 B1
(45) Date of Patent: Apr. 23, 2019

(54) APPARATUS FOR END-USER DESIGNED MESSAGING FOR FOOTWEAR

(71) Applicant: JW Retail Group, Boston, MA (US)

(72) Inventors: Kate Whitcomb, Allston, MA (US); Richard Whitcomb, Allston, MA (US)

(73) Assignee: JW Retail Group, LLC, Allston, MA (US)

( * ) Notice: Subject to any disclaimer, the term of this patent is extended or adjusted under 35 U.S.C. 154(b) by 88 days.

(21) Appl. No.: 15/366,338

(22) Filed: Dec. 1, 2016

Related U.S. Application Data

(60) Provisional application No. 62/261,574, filed on Dec. 1, 2015.

(51) Int. Cl.

| | |
|---|---|
| ***A43B 3/00*** | (2006.01) |
| ***A43B 1/00*** | (2006.01) |
| ***A43B 17/00*** | (2006.01) |
| ***A43B 23/24*** | (2006.01) |
| ***G09F 21/02*** | (2006.01) |
| *A43C 19/00* | (2006.01) |

(52) U.S. Cl.
CPC ..... *A43B 3/0078* (2013.01); *A43B 1/0072* (2013.01); *A43B 3/0005* (2013.01); *A43B 17/00* (2013.01); *A43B 23/24* (2013.01); *G09F 21/02* (2013.01); *A43C 19/00* (2013.01)

(58) Field of Classification Search
CPC ... A43B 3/0031; A43B 3/0078; A43B 3/0089; A43B 17/00
USPC ..... 36/136, 137, 43
See application file for complete search history.

(56) References Cited

U.S. PATENT DOCUMENTS

| | | | | | |
|---|---|---|---|---|---|
| 1,932,658 | A * | 10/1933 | Goodfriend | A43B 3/0078 | 101/27 |
| 5,359,790 | A * | 11/1994 | Iverson | A43B 1/0072 | 36/136 |
| 5,800,900 | A * | 9/1998 | Mitchell | A41D 27/08 | 2/244 |
| 6,115,948 | A * | 9/2000 | Mitchell | A41D 27/08 | 2/245 |
| 6,455,128 | B1 * | 9/2002 | Moon | A41D 27/08 | 36/136 |
| 2004/0221484 | A1 * | 11/2004 | Wang | A43B 17/02 | 36/29 |
| 2010/0180469 | A1 * | 7/2010 | Baucom | A43B 3/0031 | 36/100 |
| 2013/0031803 | A1 * | 2/2013 | Koch | A43B 1/0072 | 36/100 |
| 2013/0276206 | A1 * | 10/2013 | DuChene | A43B 1/0054 | 2/161.4 |

* cited by examiner

*Primary Examiner* — Marie D Bays
(74) *Attorney, Agent, or Firm* — Duquette Law Group

(57) ABSTRACT

A sock-liner assembly includes a sock-liner defining an opening, a message element container coupled to the sock-liner in proximity to the opening, and a message element disposed within the message element container. The message element is configured to display a user-defined message through the opening of the sock-liner.

18 Claims, 15 Drawing Sheets

APPARATUS FOR END-USER DESIGNED MESSAGING FOR FOOTWEAR

RELATED APPLICATIONS

This patent application claims the benefit of U.S. Provisional Application No. 62/261,574, filed on Dec. 1, 2015, entitled, "Method and Apparatus For End-User Designed Messaging For Footwear," the contents and teachings of which are hereby incorporated by reference in their entirety.

BACKGROUND

Conventional footwear can provide a variety of functions. For example, certain types of footwear are utilized for specific athletic activities (e.g., tennis, football, basketball, baseball, etc.), for day-to-day activities, or for special events (e.g., weddings, dances, etc.). In most cases, a manufacturer provides a brand or other message at some location on the footwear. For example, certain manufacturers place their brand on the outside of the shoe, such as via a stitched label or etched pattern. In another example, manufacturers can print a brand or other preconfigured message on a sock-liner inside the shoe.

SUMMARY

Conventional application of brand identification or other messages to conventional footwear suffers from a variety of deficiencies. For example, in either case presented above, the brand or message is typically preconfigured and specific to the manufacturer. As such, the end-user is typically unable to provide any input regarding the text, style, or configuration of the message.

By contrast to conventional messaging mechanism for a shoe, embodiments of the present innovation relate to an apparatus for end-user designed messaging for footwear. At the start of a purchasing process, a user can access a customer portal of a shoe design website via a computerized device. The portal enables the user to design a customized message and preview the message as applied to a sock-liner of a shoe. During the design phase, in one arrangement, the portal provides tools which allow the user to share the message designs, such as via social media, prior to purchase. Once the user completes their design and purchase, the system generates a customized message element to be used as part of a sock-liner assembly.

The sock-liner assembly can include a variety of message element containers. In one arrangement, the message element container is attached in the vicinity of an opening defined by the sock-liner of a shoe. The container can be manufactured from a substantially transparent material having a substantially flat bottom and top portions. In one arrangement, a top portion of the container can be configured with a raised element that protrudes through the opening at substantially the same height as the thickness of the sock-liner. The message element container further defines a slit or opening having a width that is substantially equal to the width of an opening defined by a sock-liner. The opening allows the manufacturer to insert the customized message element into a chamber defined by the message element container.

In one arrangement, a sock-liner assembly for a footwear element includes a sock-liner defining an opening, a message element container coupled to the sock-liner in proximity to the opening, and a message element disposed within the message element container. The message element is configured to display a user-defined message through the opening of the sock-liner.

In one arrangement, a sock-liner assembly for a footwear element includes a sock-liner defining an opening, a message element container disposed in proximity to the opening of the sock-liner, and a message element carried by the message element container, the message element configured to display a user-defined message through the opening of the sock-liner.

BRIEF DESCRIPTION OF THE DRAWINGS

The foregoing and other objects, features and advantages will be apparent from the following description of particular embodiments of the innovation, as illustrated in the accompanying drawings in which like reference characters refer to the same parts throughout the different views. The drawings are not necessarily to scale, emphasis instead being placed upon illustrating the principles of various embodiments of the innovation.

DETAILED DESCRIPTION

Embodiments of the present innovation relate to an apparatus for end-user designed messaging for footwear. At the start of a purchasing process, a user can access a customer portal of a shoe design website. The portal enables the user to design a customized message and preview the message. During the design phase, the portal provides tools to share the message designs via social media prior to purchase. Once the user completes their design and purchase, the system generates a customized message element to be used as part of a sock-liner assembly.

The sock-liner assembly can include a variety of message element container devices. In one arrangement, the message element container is attached in the vicinity of an opening defined by the sock-liner of a shoe. The container can be manufactured from a substantially transparent material having a substantially flat bottom and top portions. In one arrangement, a top portion of the container can be configured with a raised element that protrudes through the opening at substantially the same height as the thickness of the sock-liner. The message element container further defines a slit or opening having a width that is substantially equal to the width of an opening defined by a sock-liner. The opening allows the manufacturer to insert the customized message element into a chamber defined by the message element container.

Figure 1:
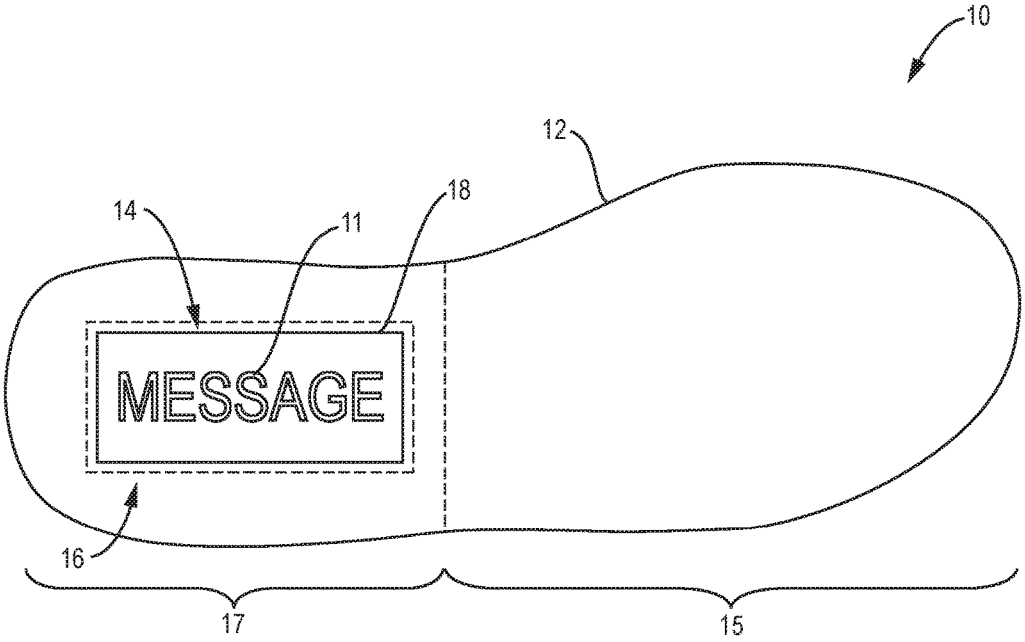
FIG. 1 illustrates a top view of a schematic representation of a sock-liner assembly, according to one arrangement.

FIG. 1 illustrates a top view of a schematic view of a sock-liner assembly 10, according to one arrangement. The sock-liner assembly 10 includes a sock-liner 12 defining an opening 14 and the message element container 16 (hereinafter "container") attached to the sock-liner 12 in the vicinity of the opening 14. While the opening 14 can be configured with a variety of geometries, in one arrangement, the opening 14 is configured as a rectangular-shaped opening. The container 16 is configured to carry or contain a message element 18, such as a customer or end-user designed message, and to display the message element 18 as part of the sock liner 12. For example, the container 16 can be manufactured from a substantially transparent material, such as a plastic material, that displays a message 11 of the message element 18 through the opening 14. Accordingly, the sock-liner assembly 10 allows custom designed messages or text 11 to be included as part of the insole of a shoe.

In one arrangement, the manufacturer secures a first portion 15 of the sock-liner assembly 10 to the inside of a shoe while leaving a second portion 17 of the sock-liner assembly unsecured. With such a configuration, the manufacturer can lift the second, unsecured portion 17 of the sock-liner assembly 10 away from the shoe, insert the message element 18 into the message element container 16, and can secure the second portion 17 to the shoe.

In another arrangement, the manufacturer secures the first and second portions 15, 17 of the sock liner assembly 10 secured to the inside of a shoe such as by gluing or another coupling mechanism. With such an arrangement, the message element container 16 is configured to allow the manufacturer to insert the message 18 into the container 16.

As provided above, the message element container 16 can be configured for use with the sock liner assembly 10 partially secured to the inside of a shoe. The following provides a description of a variety of configurations of the container 16 in such a case.

FIGS. 2A-2E illustrate an arrangement of the message element container 16. As illustrated, the container 16 is configured in a substantially rectangular-shape having a length L of approximately three inches and a width W of approximately 2½ inches. However, it is noted that the container 16 can be configured in a variety of dimensions and geometries. As further illustrated in FIGS. 2A and 2B, the container 16 includes a first or top container portion 20 and a second or bottom container portion 22 attached along three edges 24, 26, 28. In one arrangement, each of the first and second container portions 20, 22 are configured as substantially thin sheets of transparent material, such as a plastic material. In one arrangement, the top and bottom portions 20, 22 can include a base bonded seam 24, which is configured to be disposed toward a front end of the shoe, and first and second side bonded seams 26, 28. The top portion 20 can also include an overhang element 30 that extends beyond an edge 31 of the bottom portion 22. For example, the overhang element 30 can have a length of approximately ½ inch. The overhang element 30 of the top portion 22 and the edge 31 of the bottom portion 22 define a chamber 33 having an opening 32 configured to receive the message element 18.

In one arrangement, and with reference to FIG. 1, during an assembly process the manufacturer attaches the message element container 16 to the sock-liner 12 in the vicinity of the sock-liner opening 14 such that the text 11 of the message element 18 is visible through the opening 14. For example, the manufacturer can glue or stitch the base bonded seam 24, the first and second side bonded seams 26, 28, and the overhang portion 30 to the sock-liner 12 in the area of the sock liner opening 14. Such attachment allows the manufacturer to access the opening 32 and to insert the message element 18 within the container 16 along direction 35. The manufacturer can then insert the message 18 into the chamber 33 of the container 16 via opening 32 such that the message 11 is visible through the top portion 20 and the opening 14.

Figure 2A:
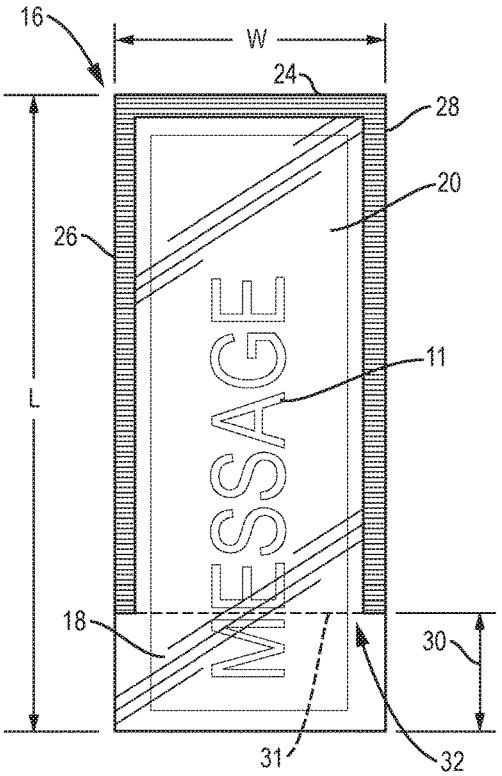
FIG. 2A illustrates a schematic representation of a top view of a message element container of the sock-liner assembly of FIG. 1, according to one arrangement.
Figure 2B:
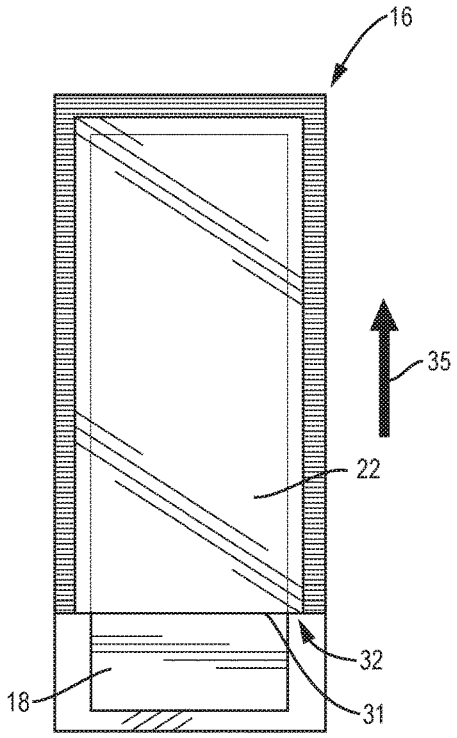
FIG. 2B illustrates a schematic representation of a bottom view of the message element container of the sock-liner assembly of FIG. 2A, according to one arrangement.
Figure 2C:
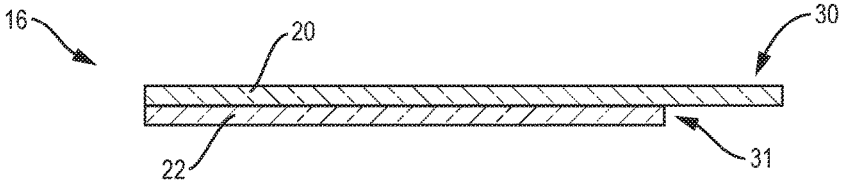
FIG. 2C illustrates a schematic representation of a side sectional view of a message element container of the sock-liner assembly absent a message element, according to one arrangement.
Figure 2D:
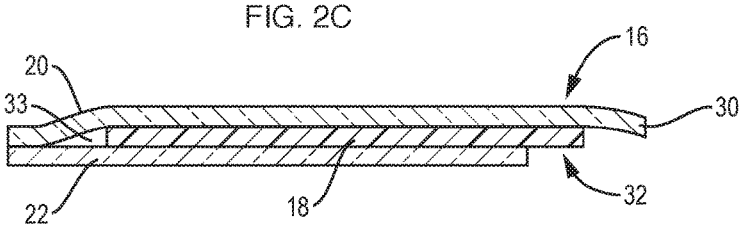
FIG. 2D illustrates a schematic representation of a side sectional view of the message element container of FIG. 2C having a message element disposed therein, according to one arrangement.
Figure 2E:
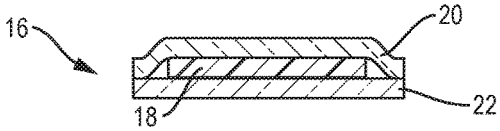
FIG. 2E illustrates a schematic representation of an end view of the message element container of the sock-liner assembly of FIG. 2C, according to one arrangement.

As shown in FIG. 2B, both the overhang element 30 and the message element 18 extend beyond the edge 31 of the bottom portion 22. At the end of the assembly process, when the manufacturer affixes the sock-liner assembly 10 to a shoe insole, such as by using an adhesive, the adhesive contacts the bottom portion 22 of the container 16, a portion of the message element 18, and the overhang element 30 of the top portion 20 of the container 16. This secures the message element 18 within the container 16, as well as to the shoe insole and minimizes shifting of the message element 18 within the container 16, such as during use.

Figure 3A:
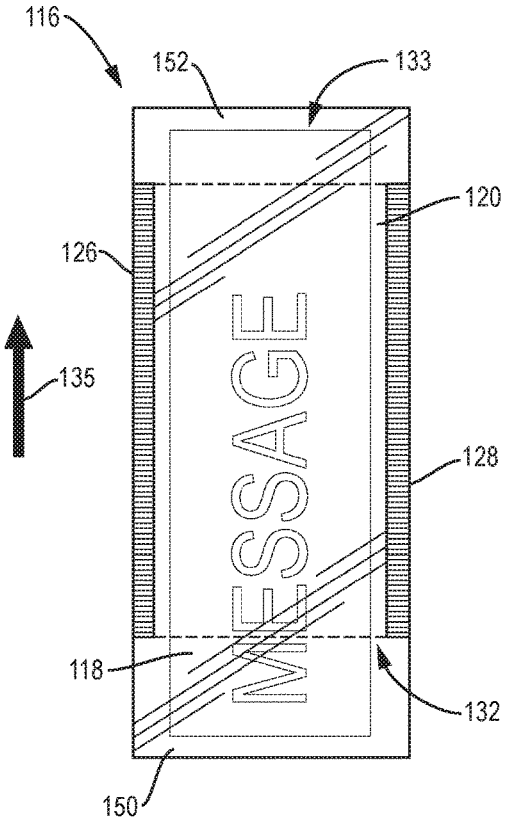
FIG. 3A illustrates a schematic representation of a top view of a message element container of the sock-liner assembly of FIG. 1, according to one arrangement.
Figure 3B:
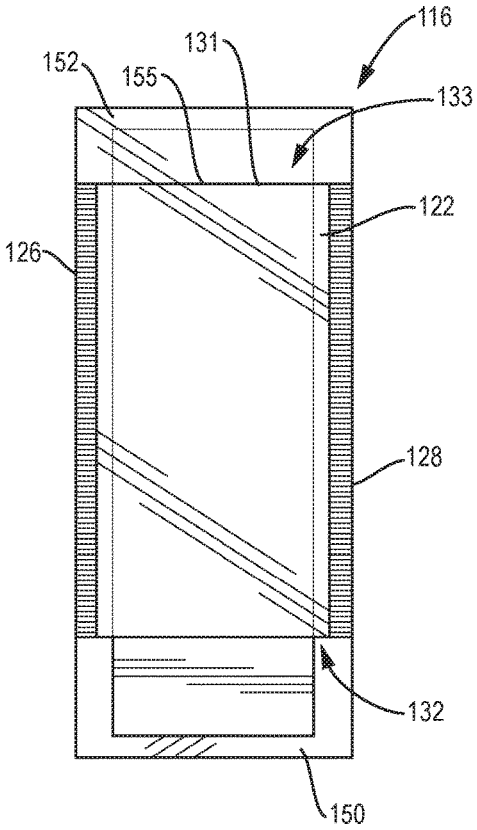
FIG. 3B illustrates a schematic representation of a bottom view of the message element container of FIG. 3A, according to one arrangement.
Figure 3C:
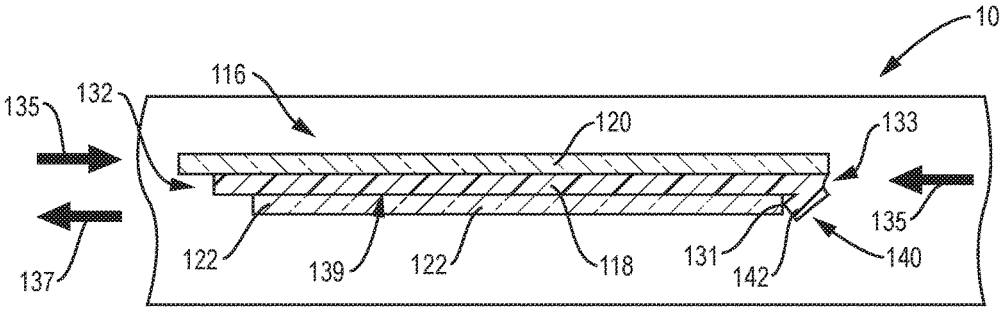
FIG. 3C illustrates a schematic representation of a side sectional view of the message element container of FIG. 3A, according to one arrangement.

FIGS. 3A-3C illustrate an arrangement of the message element container 116, which includes a mechanism configured to limit motion of a message element within the container. In one arrangement, a message element 118 and message element container 116 of the sock-liner assembly 10 are configured with a message locking system 135. For example, the container 116 includes a top portion 120 and a bottom portion 122 attached along first and second side bonded seams 126, 128 to define a chamber 139 configured to hold a message element 118. The container 116 further defines first and second openings 132, 133 disposed at opposing ends of the container 116. The seams 126, 128 are configured to be attached to the sock-liner 12, such as via a gluing or stitching procedure while the remaining edges 150, 152 of the top portion 120 can be similarly glued or stitched. Further, the message element 118 and the container 116 can include a locking mechanism 140 configured to limit movement of the message element 118 within the container 116. For example, the locking mechanism 140 can be configured as a spring tab 142 which interacts with an edge 131 of the bottom portion 122 of the container 116.

During installation, the manufacturer attaches the message element container 116 to the sock-liner 12 in the vicinity of the sock-liner opening 14. The manufacturer then inserts the message element 118 into the container 116 via the first opening 132 and advances the message element 118 along direction 135. With such a configuration, the spring tab 142 is maintained in a compressed state between the message element 118 and the bottom portion 122 of the container 116. As the spring tab 142 of the message reaches the second opening 133 of the container 116, the spring tab 142 is configured to expand away from the message element 118, as illustrated, such that the spring tab 142 engages the edge 131 of the bottom portion 122 of the container 116. Interaction between the spring tab 142 and the edge 131 limits or prevents removal of the message element 118 from the container 116, such as along direction 137, and minimizes shifting of the message element 18 within the container 16, such as during use.

Figure 4A:
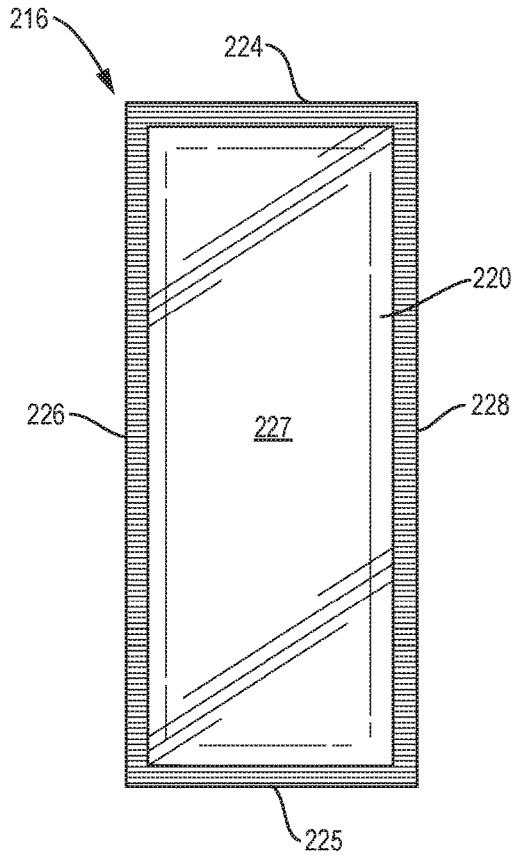
FIG. 4A illustrates a schematic representation of a top view of a message element container of the sock-liner assembly of FIG. 1, according to one arrangement.
Figure 4B:
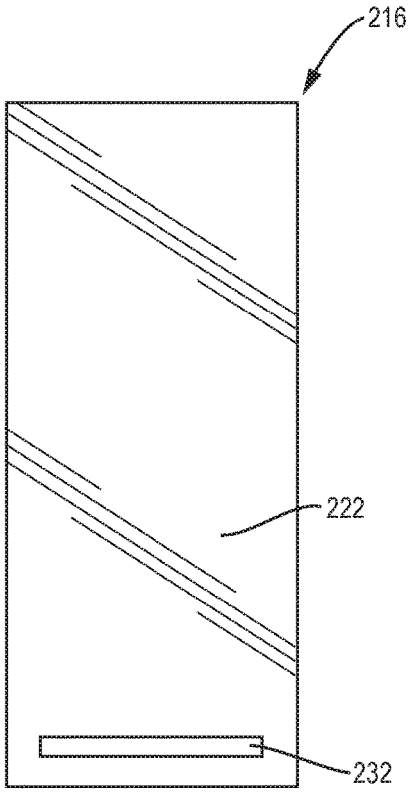
FIG. 4B illustrates a schematic representation of a bottom view of the message element container of FIG. 4A, according to one arrangement.
Figure 4C:
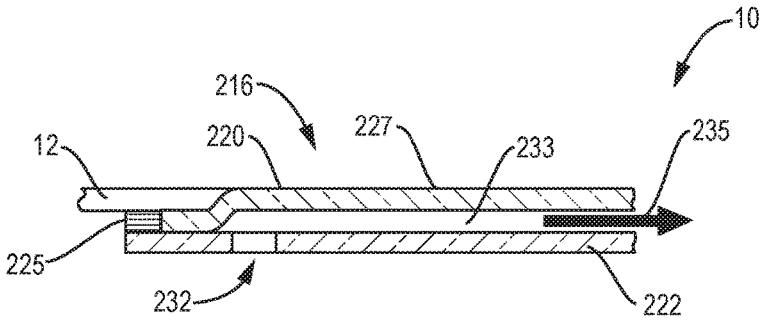
FIG. 4C illustrates a partial side sectional view of the message element container of FIG. 4A, according to one arrangement.

FIGS. 4A-4C illustrate an arrangement of the message element container 216, which includes a mechanism configured to enhance style and comfort for the wearer. In one arrangement, the message element container 216 is configured with a first or top container portion that extends into the opening 14 of the sock-liner assembly 10 and is substantially flush with the foot-contacting surface of the sock-liner assembly 10.

For example, the container 216 includes first and second container portions 220, 222 having first and second base bonded seams 224, 225 and first and second side bonded seams 226, 228. The seams 224, 225, 226, 228 secure the top and bottom portions 220, 222 together and are configured to provide a location for attachment of the container 216 to the sock-liner 12. With such a configuration, the first and second container portions 220, 222 define a chamber 233 configured to hold a message element (not shown). The bottom portion 222 defines an opening or slit 232 configured to receive the message element and to allow insertion of message element 18 within the container 216. As illustrated, the top portion 220 includes a raised element 227 having a thickness that is substantially equal to a thickness of the sock-liner 12. With such a configuration, the raised element 227 is configured to protrude through the opening 16 of the sock-liner 12 at substantially the same height as the thickness of the sock-liner 12. With such a configuration, an upper surface of the top portion 220 is substantially flush with an upper surface of the sock-liner 12.

During installation, the manufacturer attaches the message element container 216 to the sock-liner 12 such that the raised element 227 extends through the sock-liner opening 14. The manufacturer inserts a message element (not shown) into the container 216 via the opening 232 and advances the message element along direction 235. At the end of the assembly process, when the manufacturer affixes the sock-liner assembly 10 to a shoe insole, such as by using an adhesive, the adhesive contacts the bottom portion 222 of the container 216, as well as a portion of the message element. This secures the message element within the container 216, as well as to the shoe insole and minimizes shifting of the message element within the container 26.

As provided above with reference to FIG. 1, a message element container 16 can be configured for use with a sock-liner assembly 10 having both the first and second portions 15, 17 secured to the inside of a shoe. As provided above, the message element container 16 can be configured for use with such a configuration of the sock liner assembly 10. The following provides a description of a variety of configurations of the container 16.

FIGS. 5A-5D illustrates a message element container 316 which is configured to allow insertion of a message element 318 therein when the first and second portions 15, 17 are secured to the inside of a shoe, such as by gluing or another coupling mechanism. As shown, the message element container 316 includes a first container portion 320, a second container portion 322, and a third container portion 324.

The first container portion 320 is configured as a substantially flat sheet of material having a substantially rectangular shape. The second container portion 322 is also configured as a substantially flat sheet of material having a shape that mirrors the shape of the first container portion. For example, the second container portion 322 is sized and shaped as a substantially rectangular shape, corresponding to the shape of the first container portion 320. The second container portion 322 further defines an opening 340 and a tab 342 moveably disposed within the opening. For example, the tab 342 can be coupled to the second container portion 322 at a first edge 346 and can be free from the second container portion 322 at side edges 348, 350. While the tab 342 can be coupled to the second container portion 322 at the second edge 346 in a variety of ways, in one arrangement, the tab 342 is detachably connected to the second container portion 322. For example, the tab 342 can be configured with a set of perforations disposed along edge 346.

The third container portion 324 is configured as a flat sheet of substantially transparent material having a substantially rectangular shape. The third container portion 324 includes a top edge 352 that is configured to be substantially aligned with the edge 346 of the second container portion 322. The third container portion 324 further includes a tab 354 extending from the top edge 352. While the tab 354 can be coupled to the third container portion 324 at the top edge 352 in a variety of ways, in one arrangement, the tab 354 is detachably connected to the third container portion 324. For example, the tab 354 can be configured with a set of perforations disposed along edge 352. When assembled, as indicated in FIGS. 5C and 5D, the tab 342 of the second portion 322 folds onto the second portion 17 of the sock-liner 12 while the tab 354 of the third portion 324 extends over the tab 342. Accordingly, the tabs 346, 354 define an entrance path 380 to a chamber 364 for a message element 318.

Figure 5B:
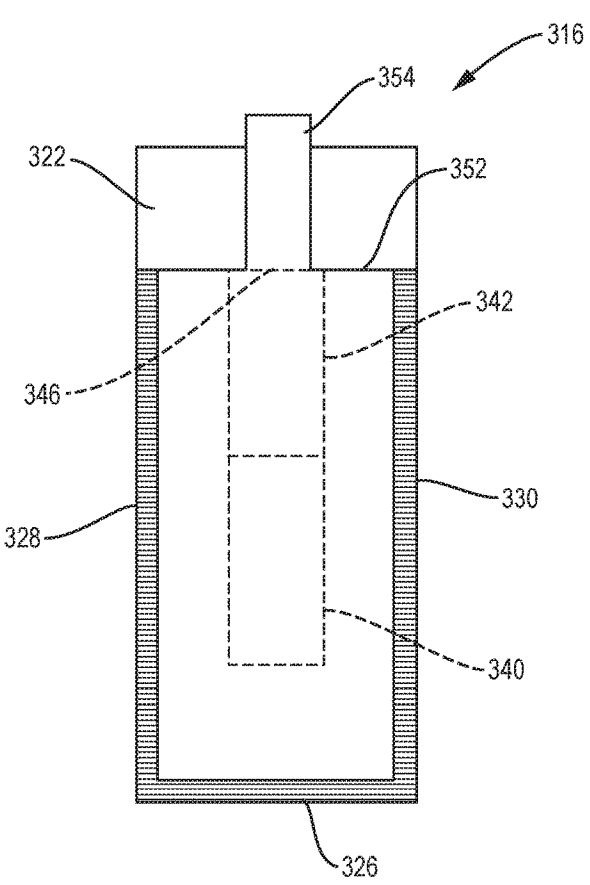
FIG. 5B illustrates a top assembled view of the message element container of FIG. 5A, according to one arrangement.
Figure 5A:
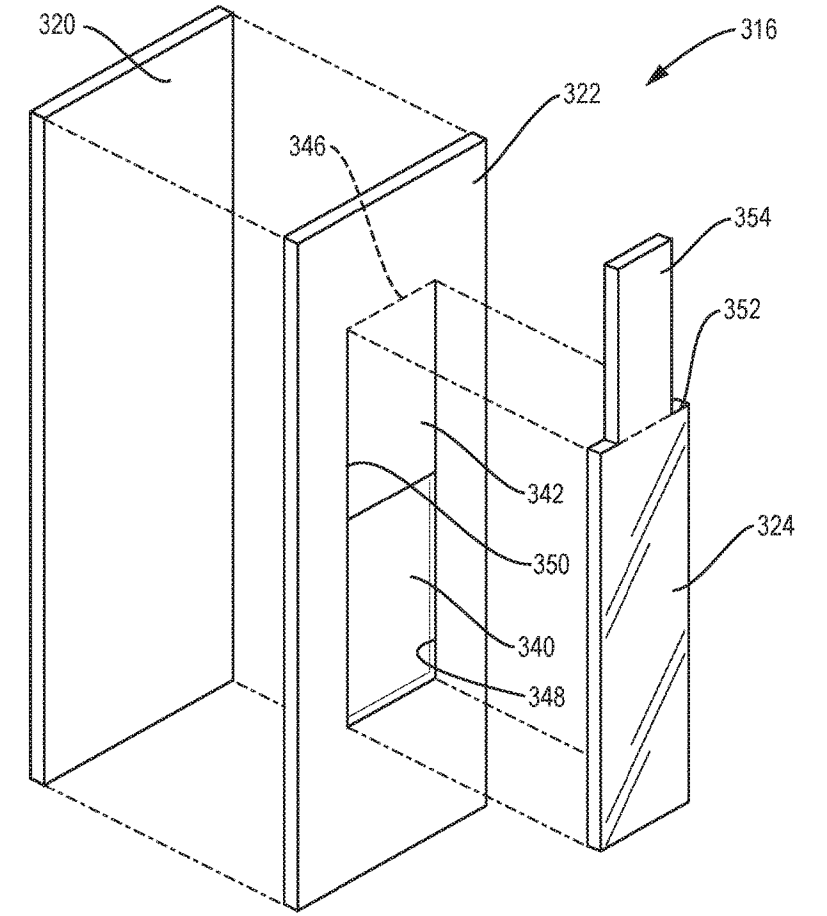
FIG. 5A illustrates an exploded view of a message element container of the sock-liner assembly of FIG. 1, according to one arrangement.
Figure 5C:
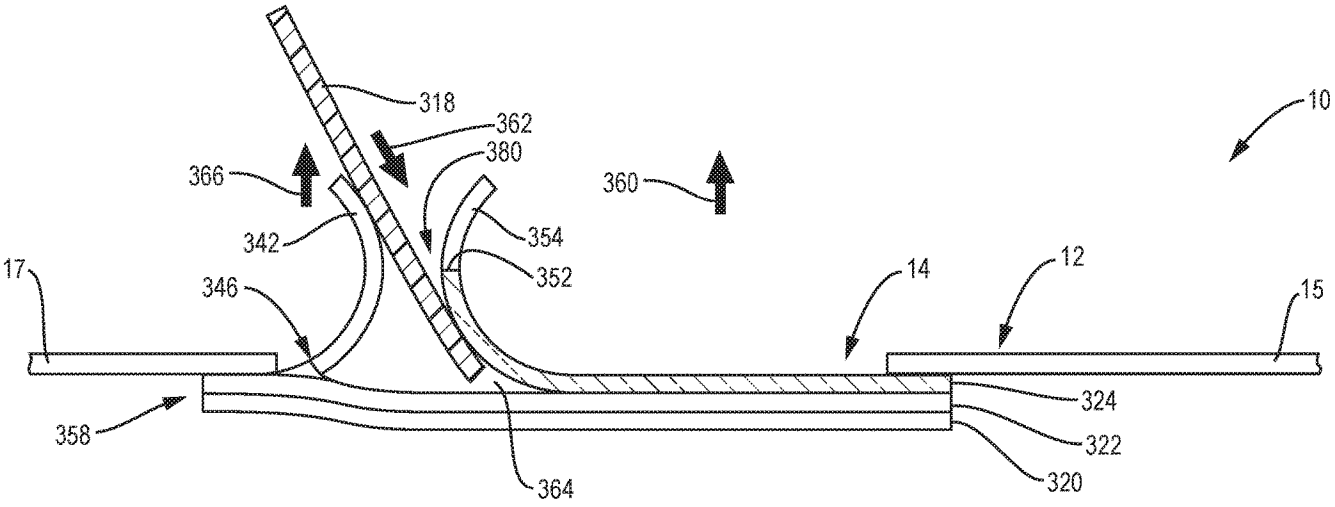
FIG. 5C illustrates a side sectional view of the message element container of FIG. 5A, according to one arrangement.
Figure 5D:
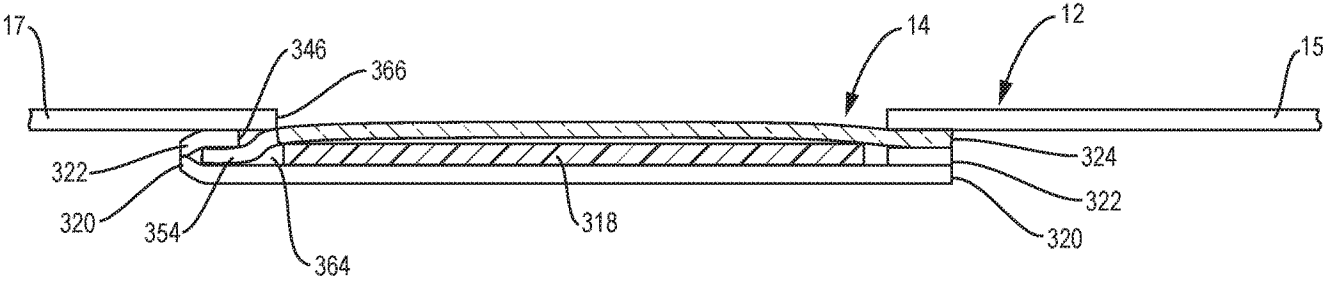
FIG. 5D illustrates a side sectional view of the message element container of FIG. 5A, according to one arrangement.

As indicated in FIGS. 5A and 5B, the portions 320, 322, 324 can be joined together along three edges 326, 328, 330. For example, the assembly of portions 320, 322, and 324 can include a base bonded seam 326 and first and second side bonded seams 328, 330. Further, as indicated in FIGS. 5C and 5D, the first and second portions 320, 322 can be joined together along base bonded seam 358. As such, the combination of the first, second, and third container portions 322, 324, 326 define a chamber 364 configured to hold a message element 318.

During a message insertion process, with reference to FIG. 5D, the manufacturer lifts and pulls the tab 354 of the third portion 324 along direction 360 to expose the opening 340 defined by the second portion 322 and to provide clearance for the insertion of the message element 318 within the opening 340. The manufacturer advances the message element 318 along direction 362 to insert the message element 318 into the chamber 364 defined by the first, second, and third portions 320, 322, 324.

With the message element 318 inserted within the chamber 364, the manufacturer lifts and pulls tab 342 along direction 366 to provide clearance for the insertion of tab 354 of the third portion 325 within the chamber 364 between the first and second portions 320, 322. As indicated in FIG. 5D, the manufacturer inserts the tab 354 into the chamber 364 between the first and second portions 320, 322 and removes the tab 342 from the second portion 322 along the second edge 346. With such removal, the second edge 346 of the second portion 322 is disposed substantially flush with an edge 366 of the opening 14 of the sock-liner 12. Accordingly, the message element 318 is secured within the chamber 364 and is viewable through the third portion 324.

FIGS. 6A-6F illustrates a message element container 416 which is configured to allow insertion of a message element 418 therein when the first and second portions 15, 17 are secured to the inside of a shoe. As shown, the message element container 416 includes a first container portion 420, a second container portion 422, and a third container portion 424.

The first container portion 420 is configured as a substantially flat sheet of material having a substantially rectangular shape. The second container portion 422 is also configured as a substantially flat sheet having a substantially rectangular shape, corresponding to the shape of the first container portion 420. The second container portion 422 further includes a first tab 442 and a second tab 443 moveably disposed within an opening 460 defined by the second container portion 422. For example, the first tab 442 can be coupled to the second container portion 422 at a first edge 446 and can be free from the second container portion 422 at side edges 448, 450. Further, the second tab 443 can be coupled to the second container portion 422 at a second edge 447 and can be free from the second container portion 422 at side edges 453, 455. While the tabs 442, 443 can be coupled to the second container portion 422 in a variety of ways, in one arrangement, the tabs 442, 443 are detachably connected to the second container portion 422. For example, the tabs 442, 443 can include a set of perforations disposed along corresponding edges 446, 447.

The third container portion 424 is configured as a flat sheet of substantially transparent material, such as a plastic material, having a substantially rectangular shape. The third container portion 424 includes a top edge 452 that is configured to be substantially aligned with the first edge 446 of the second container portion 422 and a bottom edge 462 that is configured to be substantially aligned with the second edge 447 of the second container portion 422. The third container portion 424 further includes a first tab 454 extending from the top edge 452 and a second tab 459 extending from the bottom edge 462. While the tabs 454 can be coupled to the third container portion 424 in a variety of ways, in one arrangement, the tabs 454, 459 are detachably connected to the third container portion 424. For example, the tabs 454, 459 can include a set of perforations disposed along corresponding edges 452, 462.

Figure 6C:
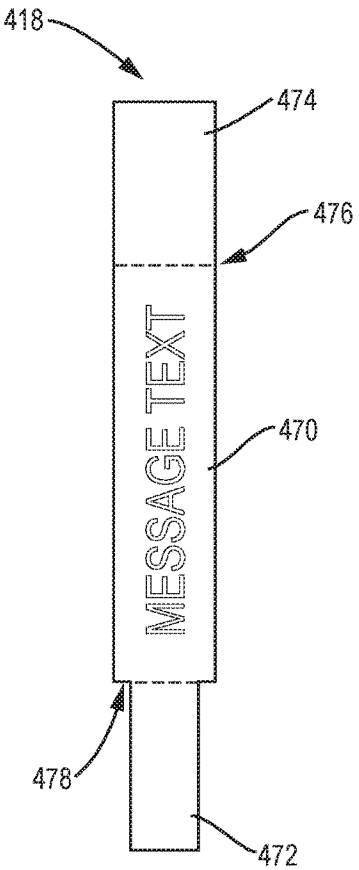
FIG. 6C illustrates a top view of a message element, according to one arrangement.
Figure 6B:
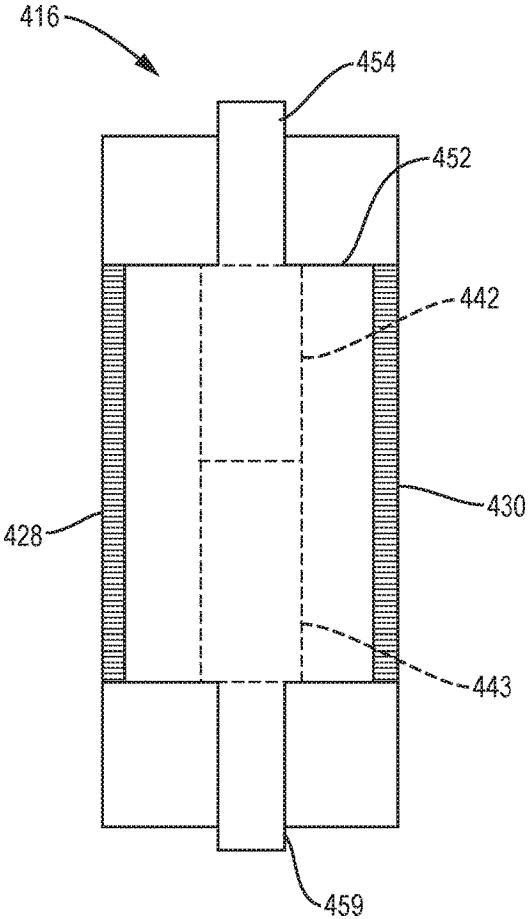
FIG. 6B illustrates a top assembled view of the message element container of FIG. 6A, according to one arrangement.
Figure 6A:
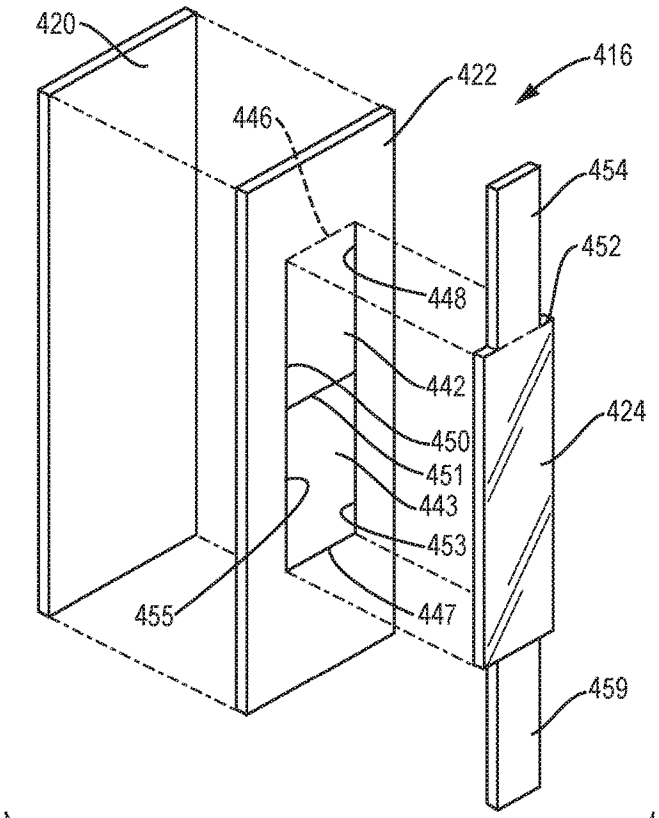
FIG. 6A illustrates an exploded view of a message element container of the sock-liner assembly of FIG. 1, according to one arrangement.

As indicated in FIG. 6B, the portions 420, 422, 424 can be joined together along two edges 428, 430. For example, the assembly of portions 420, 422, and 424 can include first and second side bonded seams 428, 430. As such, the combination of the first, second, and third container portions 422, 424, 426 define a chamber 460, as shown in FIG. 6D, configured to receive a message element 418.

Figure 6D:
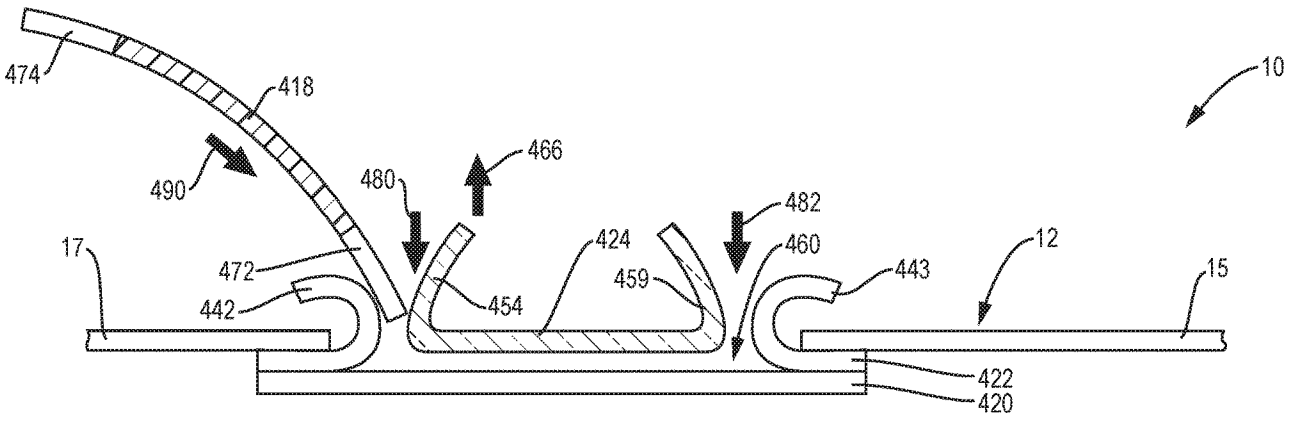
FIG. 6D illustrates a side sectional view of the message element container of FIG. 6A during assembly, according to one arrangement.
Figure 6E:
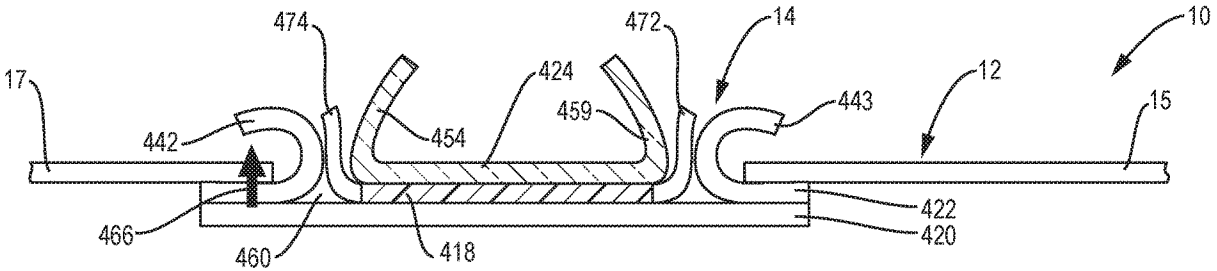
FIG. 6E illustrates a side sectional view of the message element container of FIG. 6A during assembly, according to one arrangement.

When assembled, as indicated in FIGS. 6D and 6E, the tab 442 of the second portion 422 folds onto the second portion 17 of the sock-liner 12 and the tab 443 while the tab 354 folds onto the first portion 15 of the sock-liner 12. Further, the tab 454 of the third portion 324 extends over the folded tab 342 while the tab 459 the third portion 324 extends over the folded tab 443. With such a configuration, the tabs 442, 454 define an entrance path 480 to the chamber 460 for a message element 418 while the tabs 443, 460 define an exit path 482 from the chamber 460 for the message element 418.

As illustrated in FIG. 6C, the message element 418 includes a body portion 470, a first tab 472, and a second tab 474. As illustrated, the body portion 470 is configured to be disposed within the chamber 460 such that the message disposed on the body portion 470 is aligned with, and visible through, the third container portion 424. The first and second tabs 472, 474 are configured to extend beyond the corresponding entrance and exit paths 480, 482 defined by the message element container 416 to allow accurate positioning of the message element 418 within the chamber 460. In one arrangement, each of the tabs 472, 474 are detachably connected to the message element body 470. For example, each of the tabs 472, 474 can include a set of perforations disposed along corresponding edges of the message element body 470.

During a message insertion process, with reference to FIG. 6D, the manufacturer lifts and pulls the tab 454 of the third portion 324 along direction 460 to open the entrance path 480 and expose the chamber 460 and to provide clearance for the insertion of the message element 418 within the entrance path 480. With reference to FIG. 6E, as the manufacturer advances the message element 418 along direction 490, the manufacturer positions the first tab 472 to extend through the exit path 482. As such, the manufacturer aligns the body portion 470 within the chamber 460 such that the message text is viewable though the opening 14 of the sock-liner 12. The manufacturer can then remove the tabs 472, 474 from the body portion 470 of the message element 418.

Figure 6F:
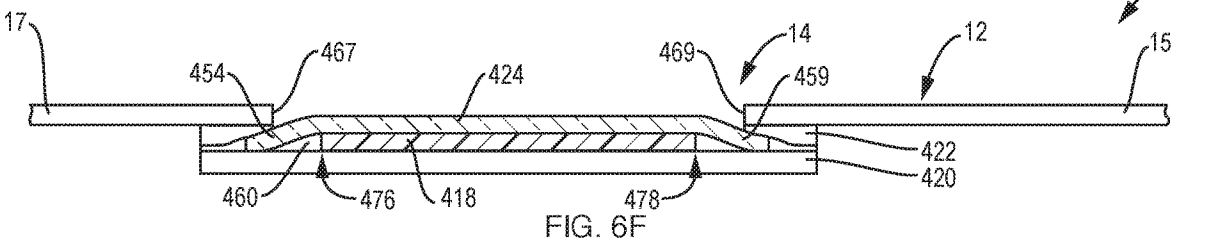
FIG. 6F illustrates a side sectional view of the message element container of FIG. 6A during assembly, according to one arrangement.

In one arrangement, with the message element 418 inserted within the chamber 460, and with reference to FIG. 6F, the manufacturer removes the tabs 472, 474 from the message element 418. The manufacturer then lifts and pulls tab 442 along direction 466 to provide clearance for the insertion of tab 454 of the third portion 424 within the chamber 460 between the first and second portions 420, 422. The manufacturer can then further lift and pull tab 443 along direction 466 to provide clearance for the insertion of tab 459 of the third portion 424 within the chamber 460 between the first and second portions 420, 422. As indicated in FIG. 6F, with the tabs 454, 459 inserted into the chamber 460 between the first and second portions 420, 422 the manufacturer can remove the tab 442 from the second portion 422 along the edge 446 and can remove the tab 443 from the second portion 422 along the edge 444. With such removal, the edges 446, 447 of the second container portion 422 are disposed substantially flush with corresponding edges 467, 469 of the opening 14 of the sock-liner 12. Accordingly, the message element 418 is secured within the chamber 460 and is viewable through the third portion 424.

As indicated above, the sock-liner assembly 10 includes a message element container 16 forms part of the sock liner assembly and is configured to receive a custom message element 18, such as a customer or end-user designed message, when the message element container is coupled to the sock liner. For example, during an assembly process, the manufacturer inserts the message element 18 into the message element container 16 such that the message element 18 is displayed as part of the sock liner 12. Such indication is by way of example only. In one arrangement, the message element container 16 carries or contains the message element 18 prior to the message element container 16 being coupled to the sock-liner 12 during the assembly process. In such an arrangement, the message element container is configured to be mechanically coupled to the sock-liner 12 during manufacture. The following description provides various examples of this configuration of the message element container 16.

Figure 7A:
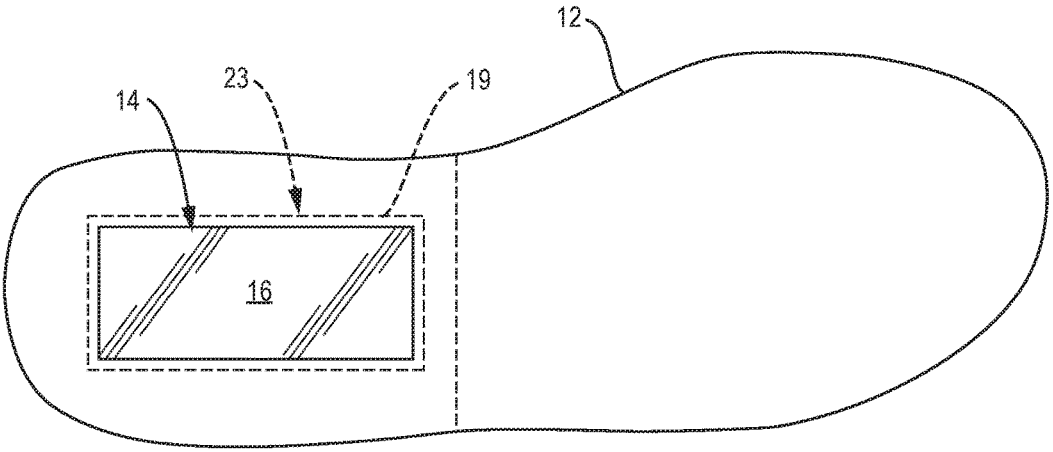
FIG. 7A illustrates a top view of a schematic representation of a sock-liner assembly, according to one arrangement.
Figure 7B:
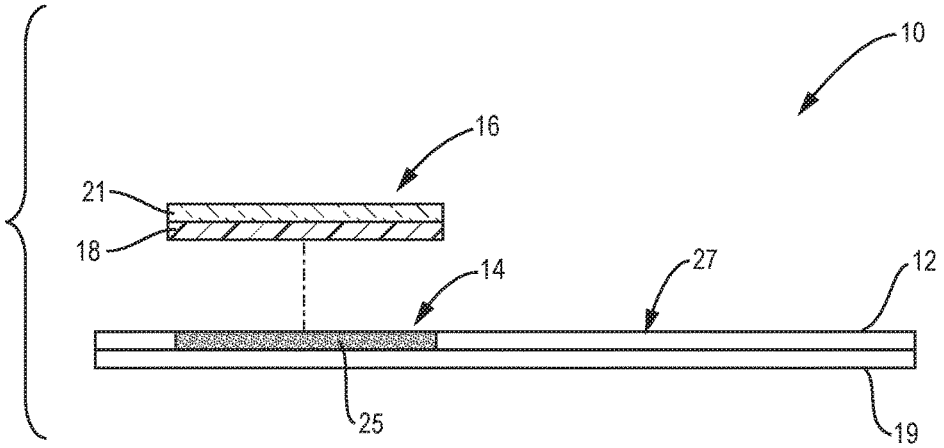
FIG. 7B illustrates an exploded view of the sock liner assembly of FIG. 5A, according to one arrangement.

In one arrangement, as illustrated in FIGS. 7A and 7B, the message element container 16 is configured as a message element 18 having a transparent covering 21, such as a laminate coating, and can be adhered to the sock-liner 12 and an insole 19 of a shoe, such as via a gluing process. For example, the opening 14 defined by the insole 19 and sock-liner 12 can be filled with an adhesive material 25 and the message element container 16 inserted into the opening 14. With such a configuration, the covering 21 of the message element 18 is substantially flush with an upper surface 27 of the sock-liner 12. In one arrangement, the manufacturer can include a decorative stitching 23 about a perimeter of the opening 14.

In one arrangement, the message element container 16 can be configured as an electronic display, such as a flexible display assembly 1318. For example, with reference to FIGS. 8A and 8B, an insole 1319 is manufactured with an indentation 1302, such as a rectangular indentation corresponding to the opening 1314 defined by the sock-liner 1312. At the time of final assembly, a flexible display assembly 1318 is disposed within the opening 1314 and indentation 1302 and secured to the insole 1319 and sock-liner 1312. In one arrangement the flexible display assembly 1318 includes a flexible bistable display 1320, such as manufactured by E Ink Corporation, and a transparent covering 1322, such as a compliant plastic covering or a substantially soft gel covering.

During the manufacturing process, the flexible display assembly 1318 is connected to a computerized device (not shown), such as having a memory and a processor, which causes the assembly 1318 to display the customer's unique message/design on the display 1320. Once disconnected from the computerized device, the bistable display requires no additional power to maintain the image, which persists permanently. The manufacturer then disposes the flexible display assembly 1318 within the insole indentation 1302 and the sock-liner opening 1314 and secures the flexible display assembly 1318 thereto, such as by a gluing process. The finished, customized label shoes can then be shipped to the customer.

As provided above, the message element container can be secured to the sock-liner 12 and/or insole 19 using an adhesive. However, in one arrangement, the message element container can be secured to the sock-liner using a coupling mechanism. For example, the message element container can be configured with a first coupling mechanism while the sock-liner is configured with a corresponding second coupling mechanism. Interaction of the first and second coupling mechanisms is configured to secure the message element container to the sock-liner. As will be described below, a variety of coupling mechanisms can be utilized to secure the message element container to the sock-liner and/or insole.

Figure 9A:
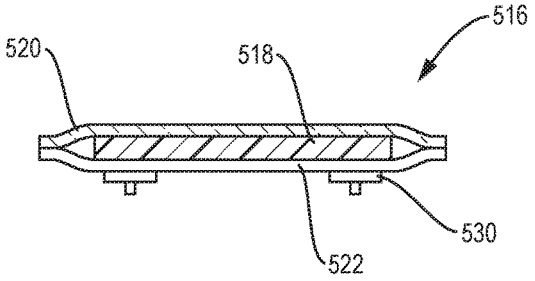
FIG. 9A illustrates a side sectional view of a message element container, according to one arrangement.
Figure 9B:
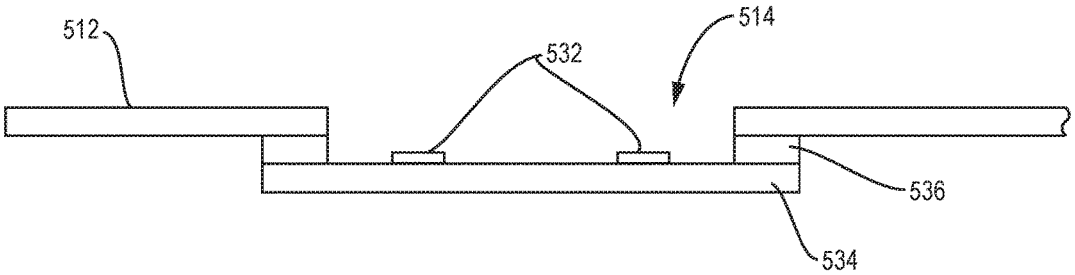
FIG. 9B illustrates a side sectional view of a sock-liner, according to one arrangement.
Figure 9C:
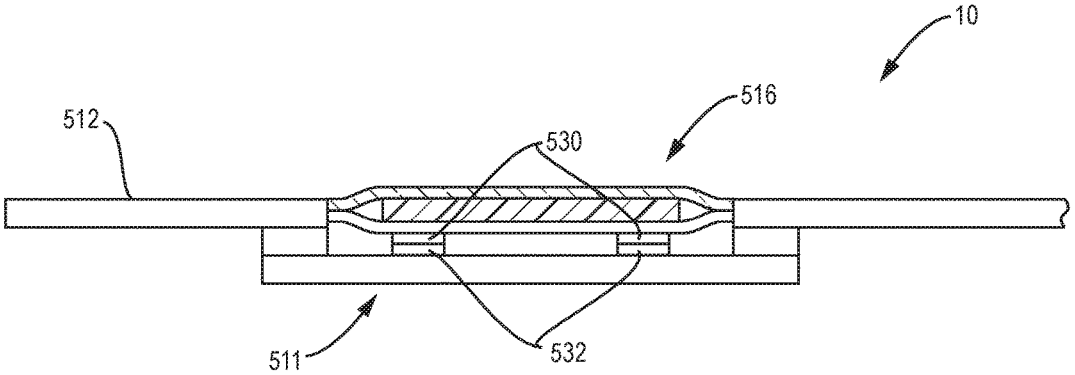
FIG. 9C illustrates a side sectional view of a sock liner assembly having the message element container of FIG. 9A and the sock-liner of FIG. 9B.

In one arrangement, as illustrated in FIGS. 9A-9C, the coupling mechanism 511 is configured as a set of snap elements 532. For example, the message element container 516 includes a first container portion 520 and a second container portion 522 with a message element 518 disposed there between. In one arrangement, the edges of the first and second container portions 520, 522 are bonded together to seal the message element 518 within a chamber formed between the portions. The first container portion 520 is configured as a substantially transparent material, such as a thin plastic material. The second container portion 522 includes a first set of snap elements 530, such as male snap elements. While two snap elements 530 are shown, the second container portion 522 can include any number of snap elements.

FIG. 9B illustrates an arrangement of a sock-liner 512 that includes a platform layer 534 coupled to an underside of the sock-liner 512, such as via a spacing layer 536. The platform layer 534 and the spacing layer 536 define a chamber 514 configured to receive the message element container 516. Further, the platform layer 534 include a set of snap elements 532 which correspond to the snap elements 530 of the message element container 516. For example, the set of snap elements 532 can be configured as female snap elements.

During an assembly process, the manufacturer inserts the message element container 516 into the cavity 514 and connects the first set of snap elements 530 with the second set of snap elements 532 to secure the message element container 516 to the sock-liner 512. The completed sock-liner assembly 10 is illustrated in FIG. 9C.

Figure 10A:
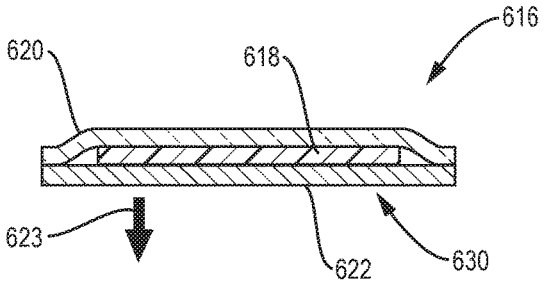
FIG. 10A illustrates a side sectional view of a message element container, according to one arrangement.
Figure 10B:
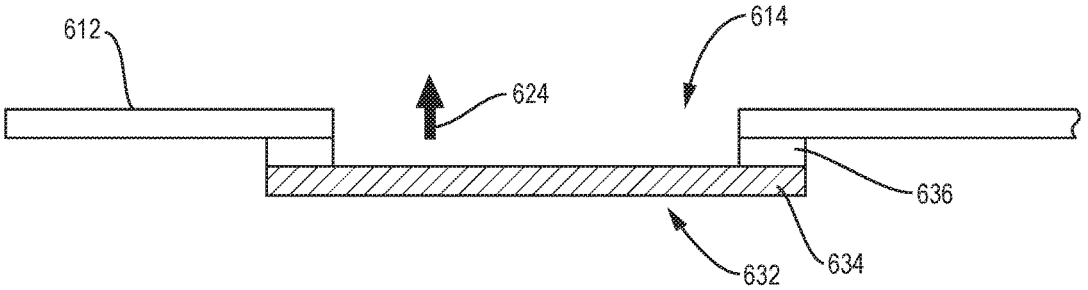
FIG. 10B illustrates a side sectional view of a sock-liner, according to one arrangement.
Figure 10C:
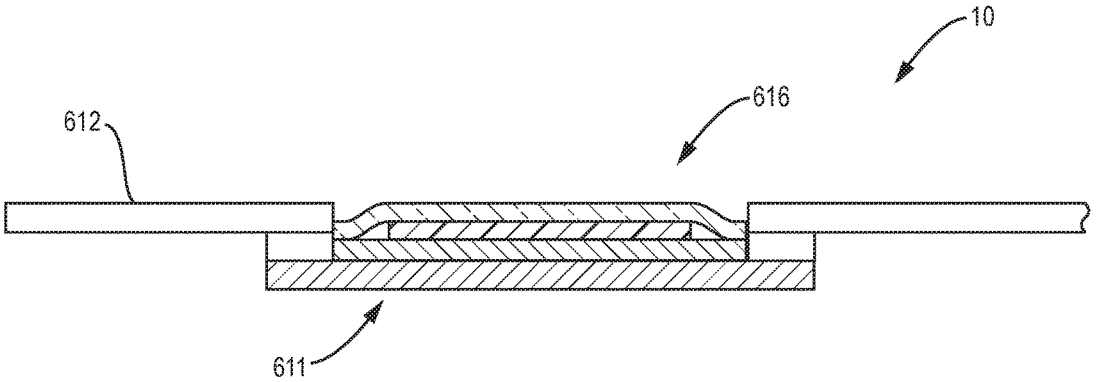
FIG. 10C illustrates a side sectional view of a sock liner assembly having the message element container of FIG. 10A and the sock-liner of FIG. 10B.

In one arrangement, as illustrated in FIGS. 10A-10C, the coupling mechanism 611 is configured as a set of magnetic elements 630, 632. For example, the message element container 616 includes a first container portion 620 and a second container portion 622 with a message element 618 disposed there between. In one arrangement, the edges of the first and second container portions 620, 622 are bonded together to seal the message element 618 within a chamber formed between the portions 620, 622. The first container portion 620 is configured as a substantially transparent material, such as a thin plastic material. The second container portion 622 is configured as a first magnetic element 630, which provides a first magnetic force (e.g., a "+" force) along direction 623.

FIG. 10B illustrates an arrangement of a sock-liner 612 that includes a platform layer 634 coupled to an underside of the sock-liner 612, such as via a spacing layer 636. The platform layer 634 and the spacing layer 636 define a chamber 614 configured to receive the message element container 616. Further, the platform layer 634 is configured as a second magnetic element 632, which provides a second magnetic force (e.g., a "−" force) along direction 624.

During an assembly process, the manufacturer inserts the message element container 616 into the cavity 614 and allows the first and second magnetic elements 630, 632 to contact each other. As a result of the magnetic force between the first and second magnetic elements 630, 632, the message element container 616 and the sock-liner 612 are secured to each other. The completed sock-liner assembly 10 is illustrated in FIG. 10C.

In one arrangement, as illustrated in FIGS. 11A-11D, the coupling mechanism 711 is configured as an interference-fit mechanism 724, 730. For example, with reference to FIGS. 11A and 11B, the message element container 716 includes a first container portion 720 and a second container portion 722 with a message element 718 disposed there between. In one arrangement, the edges of the first and second container portions 720, 722 are bonded together to seal the message element 718 within a chamber formed between the portions 720, 722. The first container portion 720 is configured as a substantially transparent material, such as a thin plastic material. The second container portion 722 is configured with a first interference fit portion 724. For example, the first interference fit portion 724 is configured as a tab (i.e., male portion) that extends about the outer periphery of the message element container 716. As will be described below, the tab 724 is configured to couple with a corresponding interference fit mechanism associated with the sock-liner 712.

Figure 11A:
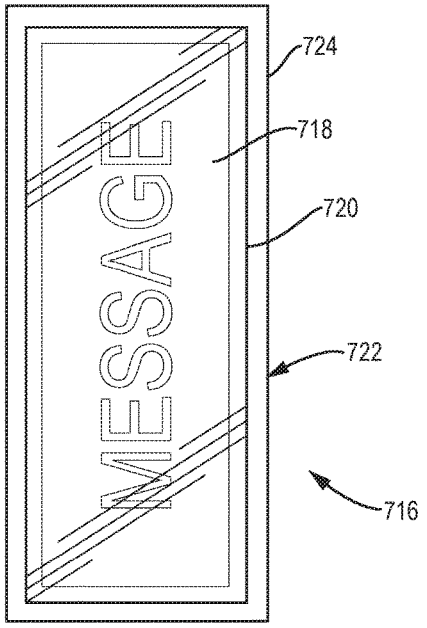
FIG. 11A illustrates a top view of a message element container, according to one arrangement.
Figure 11B:
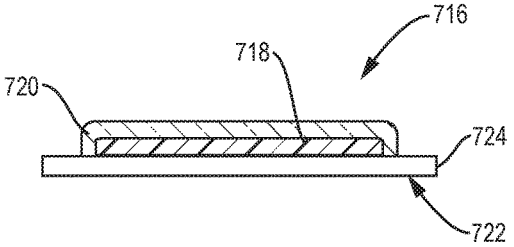
FIG. 11B illustrates a front sectional view of the message element container of FIG. 11A.
Figure 11C:
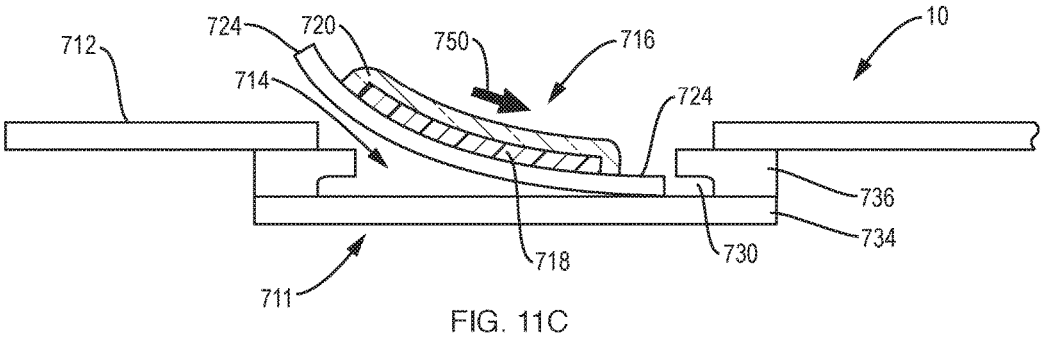
FIG. 11C illustrates a side sectional view of a sock-liner, according to one arrangement.

FIG. 11C illustrates an arrangement of the sock-liner 712 that includes a platform layer 734 coupled to an underside of the sock-liner 61, via a spacing layer 736. The spacing layer 736 defines a second interference fit portion 730, such as a chamber (i.e., female portion) configured to receive the tab 724 of the message element container 716.

Figure 11D:
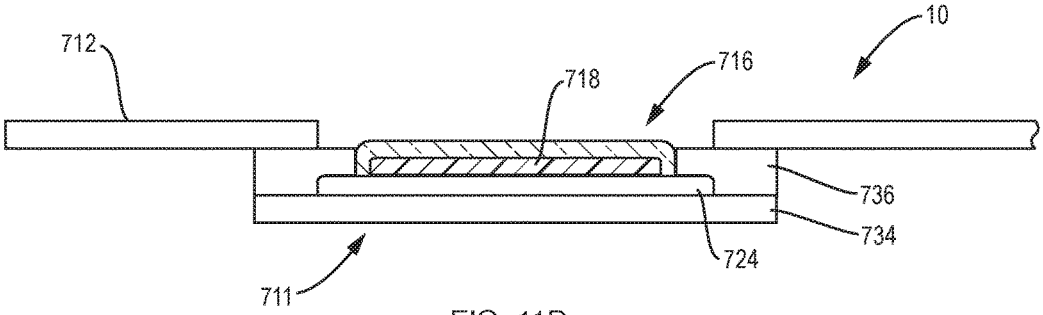
FIG. 11D illustrates a side sectional view of a sock liner assembly having the message element container of FIG. 11A and the sock-liner of FIG. 11C.

During an assembly process, with reference to FIGS. 11C and 11D, the manufacturer inserts the message element container 716 into the cavity 714 defined by the sock-liner 712 along direction 750. With such placement, the tab 724 of the message element container 716 is disposed within the chamber 730 defined by the spacing layer 736. The tab 724 and the chamber 730 form an interference-fit there between, which couples and secures the message element container 716 to the sock-liner 712. The completed sock-liner assembly 10 is illustrated in FIG. 11D.

Figure 12A:
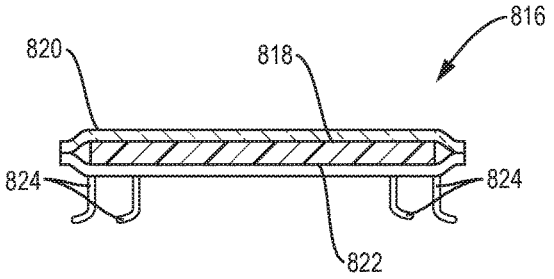
FIG. 12A illustrates a side sectional view of a message element container, according to one arrangement.
Figure 12B:
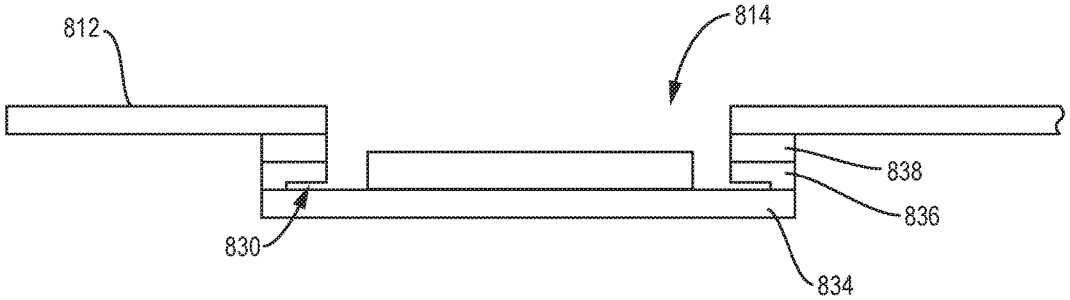
FIG. 12B illustrates a side sectional view of a sock-liner, according to one arrangement.
Figure 12C:
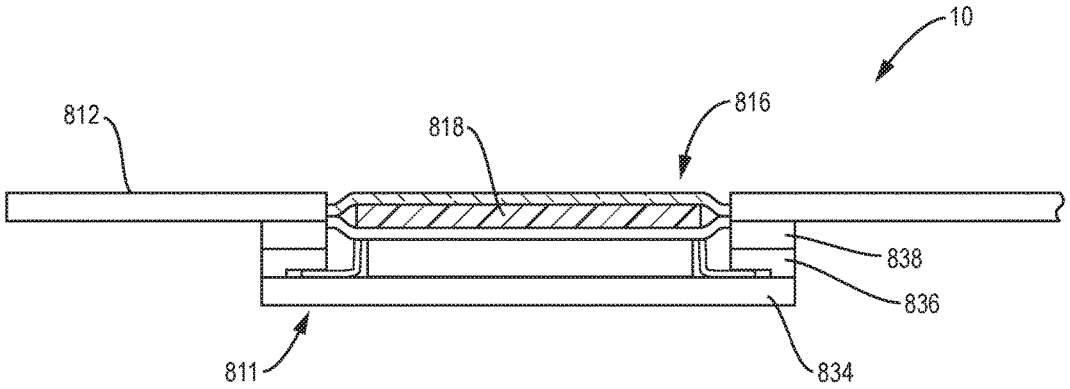
FIG. 12C illustrates a side sectional view of a sock liner assembly having the message element container of FIG. 12A and the sock-liner of FIG. 12B.

In one arrangement, as illustrated in FIGS. 12A-12C, the coupling mechanism 811 is also configured as an interference-fit mechanism 824, 830. For example, with reference to FIG. 12A, the message element container 816 includes a first container portion 820 and a second container portion 822 with a message element 818 disposed there between. In one arrangement, the edges of the first and second container portions 820, 822 are bonded together to seal the message element 818 within a chamber formed between the portions 820, 822. The first container portion 820 is configured as a substantially transparent material, such as a thin plastic material. The second container portion 822 is configured with a first interference fit mechanism 824 such as a set of tabs or prongs (i.e., male portions) that extend in a substantially perpendicular direction to a surface of the second container portion 822 of the message element container 716. As will be described below, the tabs 824 are configured to couple with a corresponding interference fit mechanism 830 associated with the sock-liner 812.

FIG. 12B illustrates an arrangement of the sock-liner 812 that includes a platform layer 834 coupled to an underside of the sock-liner 61, via a first spacing layer 836 and a second spacing layer 838. In one arrangement, the second spacing layer 836 is partially bonded to the platform layer 834 to define a second interference fit portion 830, such as a chamber, configured to receive the tabs 824 of the message element container 816.

During an assembly process, with reference to FIGS. 12B and 12C, the manufacturer inserts the message element container 816 into the cavity 814 defined by the sock-liner 812 and inserts the tabs 824 into the chambers 830 defined by the platform layer 834 and the first spacing layer 836. With such placement, the tab 824 and the chamber 830 form an interference-fit there between, which couples and secures the message element container 816 to the sock-liner 812. The completed sock-liner assembly 10 is illustrated in FIG. 12C.

Figure 13:
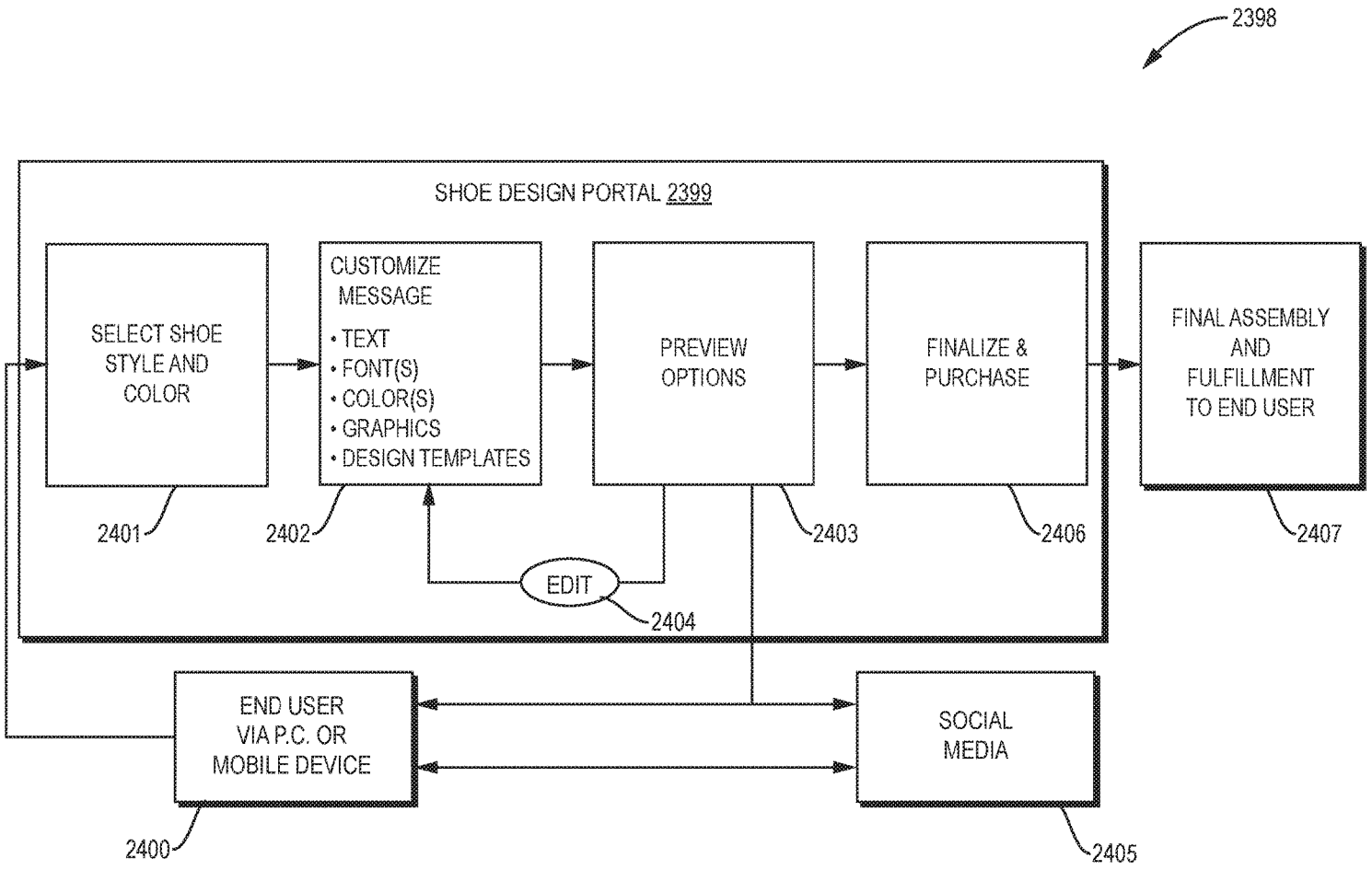
FIG. 13 illustrates a shoe design portal as displayed by a computerized device and a flowchart of a procedure performed by the shoe design portal, according to one embodiment.

As provided above, at the start of a purchasing process, a user can access a customer portal of a shoe design website which allows the user to design a customized message for the message element and preview the message. FIG. 13 illustrates an arrangement of a computerized device 2398, having a processor and a memory configured to provide a shoe design portal 2399.

For example, during a purchasing process, an end user can log into the computerized device 2398 to access the shoe design portal 2399 using a network-connected computerized device 2400, such as a mobile computerized device. As illustrated, the portal 2399 enables the user, via user device 2400, to select a particular style of shoe 2401, and then design a fully customized message 2402 (i.e. text, font(s), color(s), graphic elements, or selections from a range of professionally designed templates). The portal 2399 is configured with a preview option 2403 which allows the user to preview one or more design options in a selected shoe. The user can either further edit these options to their liking using an editing feature 2404, and/or utilize the portal to share the images with the user's network via social media using sharing option 2405 to get input from friends. Once the user has completed their design, the user can access a finalization and purchase feature 2406 to finalize and purchase the shoes on the portal 2406. The system 2399 is configured to further automatically generate the message element 18 to be installed in the device at final assembly 2407.

While various embodiments of the innovation have been particularly shown and described, it will be understood by those skilled in the art that various changes in form and details may be made therein without departing from the spirit and scope of the innovation as defined by the appended claims.

Figure 8A:
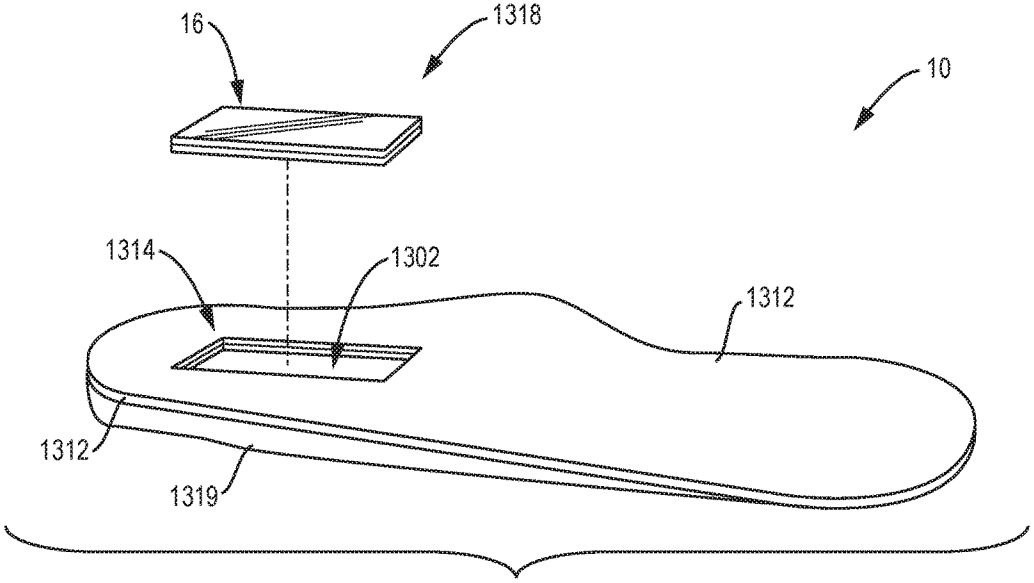
FIG. 8A illustrates an exploded view of a schematic representation of a message element container and sock-liner/insole assembly, according to one arrangement.
Figure 8B:
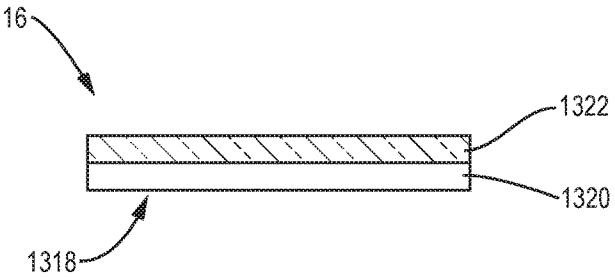
FIG. 8B illustrates a side view of the message element container of FIG. 8A, according to one arrangement.

For example, FIGS. 8A and 8B indicate a shoe as having a sock-liner 12 and an insole 19. Such illustration is by way of example only. In one arrangement, the sock-liner and insole can be integrated into a single unit. Further, in one arrangement, the sock-liner assembly 10 can be applied to any portion of a conventional shoe, rather than to an insole. For example, for a pair of high-heeled shoes, the sock-liner assembly can be applied to the sole or base of the shoe.

In another example, with reference to FIG. 1, the sock-liner assembly 10 was indicated as including a sock-liner 12 defining an opening 14 and the message element container 16 (hereinafter "container") attached to the sock-liner 12 in the vicinity of the opening 14. Such indication was by way of example only. In one arrangement, the message element container 16 is disposed in proximity to the opening 14 of the sock-liner 12. In such an arrangement, the message element container 16 can be connected to the insole of a shoe or footwear element with the sock-liner 12 disposed on the insole such that the opening is aligned with the message element container 16. Accordingly, the message element container 16 can display a user-defined message of the message element 18 through the opening of the sock-liner.

What is claimed is:

1. A sock-liner assembly for a footwear element, comprising:

a sock-liner defining an opening;

a message element container coupled to the sock-liner in proximity to the opening;

a message element carried by the message element container, the message element configured to display a user-defined message through the opening of the sock-liner;

a spacing layer coupled to an underside of the sock-liner; and a platform layer coupled to an underside of the spacing layer, the sock-liner, the spacing layer, and the platform layer defining a chamber configured to receive a tab of the message element container.

2. The sock-liner assembly of claim 1, wherein the message element container comprises at least a bottom container portion and a top container portion, the top container portion disposed within the opening defined by the sock-liner and the top container portion configured as a substantially transparent element.

3. The sock-liner assembly of claim 1, wherein the message element container is configured as a flexible display assembly having a bistable display and a substantially compliant plastic covering.

4. The sock-liner assembly of claim 1, wherein the sock-liner and the message element container comprise a coupling mechanism configured to couple the message element container to the sock-liner in proximity to the opening.

5. The sock-liner assembly of claim 4, wherein the coupling mechanism comprises an interference fit mechanism having a first interference fit mechanism associated with the message element container and a second interference fit mechanism associated with the sock-liner.

6. The sock-liner assembly of claim 5, wherein:

the first interference fit mechanism comprises the tab, the tab extending about the outer periphery of the message element container; and the second interference fit mechanism comprises the chamber defined by the sock-liner, the spacing layer, and the platform layer, the chamber configured to receive the tab of the message element container.

7. The sock-liner assembly of claim 1, wherein the message element container is configured as an electronic display.

8. The sock-liner assembly of claim 1, wherein the user-defined message comprises at least one of a text message and a graphic message.

9. The sock-liner assembly of claim 1, wherein the tab of the message element container extends about the outer periphery of the message element container.

10. The sock-liner assembly of claim 1, wherein the user-defined message comprises at least one of a text message and a graphic message.

11. A sock-liner assembly for a footwear element, comprising:

a sock-liner defining an opening;

a message element container disposed in proximity to the opening of the sock-liner;

a message element carried by the message element container, the message element configured to display a user-defined message through the opening of the sock-liner;

a spacing layer coupled to an underside of the sock-liner; and a platform layer coupled to an underside of the spacing layer, the sock-liner, the spacing layer, and the platform layer defining a chamber configured to receive a tab of the message element container.

12. The sock-liner assembly of claim 11, wherein the message element container comprises at least a bottom container portion and a top container portion, the top container portion disposed within the opening defined by the sock-liner and the top container portion configured as a substantially transparent element.

13. The sock-liner assembly of claim 11, wherein the message element container is configured as a flexible display assembly having a bistable display and a substantially compliant plastic covering.

14. The sock-liner assembly of claim 11, wherein the sock-liner and the message element container comprise a coupling mechanism configured to couple the message element container to the sock-liner in proximity to the opening.

15. The sock-liner assembly of claim 14, wherein the coupling mechanism comprises an interference fit mechanism having a first interference fit mechanism associated with the message element container and a second interference fit mechanism associated with the sock-liner.

16. The sock-liner assembly of claim 15, wherein:

the first interference fit mechanism comprises the tab, the tab extending about the outer periphery of the message element container; and the second interference fit mechanism comprises the chamber defined by the sock-liner, the spacing layer, and the platform layer, the chamber configured to receive the tab of the message element container.

17. The sock-liner assembly of claim 11, wherein the message element container is configured as an electronic display.

18. The sock-liner assembly of claim 11, wherein the tab of the message element container extends about the outer periphery of the message element container.

* * * * *